US007322847B2

(12) United States Patent
Hashim et al.

(10) Patent No.: US 7,322,847 B2
(45) Date of Patent: Jan. 29, 2008

(54) 110-STYLE CONNECTING BLOCK WITH BALANCED INSULATION DISPLACEMENT CONTACTS

(75) Inventors: Amid Hashim, Plano, TX (US); Scott M. Keith, Richardson, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 11/689,047

(22) Filed: Mar. 21, 2007

(65) Prior Publication Data

US 2007/0178744 A1 Aug. 2, 2007

Related U.S. Application Data

(63) Continuation of application No. 11/154,836, filed on Jun. 16, 2005, now Pat. No. 7,223,115.

(60) Provisional application No. 60/687,112, filed on Jun. 3, 2005.

(51) Int. Cl.
*H01R 4/24* (2006.01)

(52) U.S. Cl. ..... 439/403; 439/942

(58) Field of Classification Search ..... 439/403, 439/404, 405, 942

See application file for complete search history.

(56) References Cited

U.S. PATENT DOCUMENTS 4,127,312 A * 11/1978 Fleischhacker et al. ..... 439/403
4,359,257 A * 11/1982 Lopinski et al. ..... 439/405
4,470,655 A * 9/1984 Kalka et al. ..... 439/397
4,475,786 A * 10/1984 Root et al. ..... 439/404
4,655,528 A * 4/1987 Groft ..... 439/404
4,897,041 A * 1/1990 Heiney et al. ..... 439/404
5,199,899 A * 4/1993 Ittah ..... 439/403
5,226,835 A 7/1993 Baker et al.
5,399,106 A * 3/1995 Ferry ..... 439/620
5,683,268 A * 11/1997 Drach et al. ..... 439/404
5,722,850 A * 3/1998 White ..... 439/404
5,730,608 A * 3/1998 Legrady ..... 439/78
5,762,516 A 6/1998 Itoga et al.
5,779,504 A * 7/1998 Dominiak et al. ..... 439/709
5,961,340 A * 10/1999 Littlejohn et al. ..... 439/403
5,961,341 A * 10/1999 Knowles et al. ..... 439/403
6,107,578 A 8/2000 Hashim
6,247,974 B1 * 6/2001 Jenner et al. ..... 439/746

(Continued)

OTHER PUBLICATIONS

International Search Report and the Written Opinion of the International Searching Authority for PCT Application No. PCT/US2006/021472 dated Oct. 12, 2006.

(Continued)

*Primary Examiner*—Tulsidas C. Patel
*Assistant Examiner*—Harshad Patel
(74) *Attorney, Agent, or Firm*—Myers Bigel Sibley & Sajovec

(57) ABSTRACT

An insulation displacement contact (IDC) includes: upper and lower ends, each of the upper and lower ends including a slot configured to receive a conductor therein, the slots being generally parallel and non-collinear; and a transitional area merging with the upper and lower ends. An IDC of this configuration can be employed, for example, in 110-style connectors, and can enable such connectors to compensate for differential to common mode crosstalk between adjacent IDC pairs.

20 Claims, 4 Drawing Sheets

U.S. PATENT DOCUMENTS 6,288,334 B1 * 9/2001 Hennum ..... 174/52.1
6,309,240 B1 * 10/2001 Daoud ..... 439/403
6,494,723 B2 * 12/2002 Yamane et al. ..... 439/76.2
6,592,395 B2 7/2003 Brown et al.
6,612,880 B2 * 9/2003 Arnett et al. ..... 439/825
6,666,706 B1 * 12/2003 Jones et al. ..... 439/405
6,716,054 B1 4/2004 Denovich et al.
6,729,899 B2 * 5/2004 Aekins et al. ..... 439/404
6,878,004 B2 * 4/2005 Oh ..... 439/250

OTHER PUBLICATIONS

GP6 Plus Connecting Block, Panduit Corp., http://www.panduit.com/products/Products.asp?param.

* cited by examiner

110-STYLE CONNECTING BLOCK WITH BALANCED INSULATION DISPLACEMENT CONTACTS

RELATED APPLICATIONS

This application is Continuation of U.S. patent application Ser. No. 11/154,836, filed Jun. 16, 2005 now U.S. Pat. No. 7,223,115, which in turn claims priority from U.S. Provisional Patent Application Ser. No. 60/687,112, filed Jun. 3, 2005, the disclosures of each of which are hereby incorporated herein in their entireties.

FIELD OF THE INVENTION

The present invention relates generally to communications connectors and more specifically to 110-style communications connectors.

BACKGROUND OF THE INVENTION

In an electrical communication system, it is sometimes advantageous to transmit information signals (video, audio, data) over a pair of wires (hereinafter "wire-pair" or "differential pair") rather than a single wire, wherein the transmitted signal comprises the voltage difference between the wires without regard to the absolute voltages present. Each wire in a wire-pair is susceptible to picking up electrical noise from sources such as lightning, automobile spark plugs and radio stations to name but a few. Because this type of noise is common to both wires within a pair, the differential signal is typically not disturbed. This is a fundamental reason for having closely spaced differential pairs.

Of greater concern, however, is the electrical noise that is picked up from nearby wires or pairs of wires that may extend in the same general direction for some distances and not cancel differentially on the victim pair. This is referred to as crosstalk. Particularly, in a communication system involving networked computers, channels are formed by cascading connectors and cable segments. In such channels, the proximities and routings of the electrical wires (conductors) and contacting structures within the connectors also can produce capacitive as well as inductive couplings that generate near-end crosstalk (NEXT) (i.e., the crosstalk measured at an input location corresponding to a source at the same location) as well as far-end crosstalk (FEXT) (i.e., the crosstalk measured at the output location corresponding to a source at the input location). This crosstalk occurs from closely-positioned wires over a short distance. In all of the above situations, undesirable signals are present on the electrical conductors that can interfere with the information signal. As long as the same noise signal is added to each wire in the wire-pair, the voltage difference between the wires will remain about the same and differential crosstalk is not induced, while at the same time the average voltage on the two wires with respect to ground reference is elevated and common mode crosstalk is induced. On the other hand, when an opposite but equal noise signal is added to each wire in the wire pair, the voltage difference between the wires will be elevated and differential crosstalk is induced, while the average voltage on the two wires with respect to ground reference is not elevated and common mode crosstalk is not induced. The term "differential to differential crosstalk" refers to a differential source signal on one pair inducing a differential noise signal on a nearby pair. The term "differential to common mode crosstalk" refers to a differential source signal on one pair inducing a common mode noise signal on a nearby pair.

110-style cross-connect wiring systems are well known and are often seen in wiring closets terminating a large number of incoming and outgoing wiring systems. Cross-connect wiring systems commonly include index strips mounted on terminal block panels which seat individual wires from cables that connect with 110-style punch-down wire connecting blocks that are subsequently interconnected with either interconnect wires or patch cord connectors encompassing one or more pairs. A 110-style wire connecting block has a dielectric housing containing a plurality of double-ended slotted beam insulation displacement contacts (IDCs) that typically connect at one end with a plurality of wires seated on the index strip and with interconnect wires or flat beam contact portions of a patch cord connector at the opposite end.

Two types of 110-style connectors are most common. The first type is a connector in which the IDCs are generally aligned with one another in a single row (see, e.g., U.S. Pat. No. 5,733,140 to Baker, III et al., the disclosure of which is hereby incorporated herein in its entirety). The second type is a connector in which the IDCs are arranged in two rows and are staggered relative to each other (see, e.g., GP6 Plus Connecting Block, available from Panduit Corp., Tinley Park, Ill. ). In either case, the pairs sequence from left to right, with each pair consisting of a positive polarized terminal designated as the "TIP" and a negatively polarized terminal designated as the "RING", The staggered arrangement results in lower differential to differential crosstalk levels in situations in which interconnect wires (rather than patch cord connectors) are used. In such situations, the aligned type 110-style connector relies on physical separation of its IDCs or compensation in an interconnecting patch cord connector to minimize unwanted crosstalk, while the staggered arrangement, which can have IDCs that are closer together, combats differential crosstalk by locating each IDC in one pair approximately equidistant from the two IDCs in the adjacent pair nearest to it; thus, the crosstalk experienced by the two IDCs in the adjacent pair is essentially the same, with the result that its differential crosstalk is largely canceled.

These techniques for combating crosstalk have been largely successful in deploying 110-style connectors in channels supporting signal transmission frequencies under 250 MHz. However, increased signal transmission frequencies and stricter crosstalk requirements have identified an additional problem: namely, differential to common mode crosstalk. This problem is discussed at some length in co-pending and co-assigned U.S. patent application Ser. No. 11/044,088, filed Mar. 25, 2005, the disclosure of which is hereby incorporated herein in its entirety. In essence, differential to common mode crosstalk occurs when one pair of conductors behaves as a single "phantom" conductor when another pair of conductors is differentially excited. Thus, when physical proximities of the conductors of one pair to the conductors of a second pair differ significantly, uncompensated differential to common mode crosstalk can occur. Neither of the 110-style connectors discussed above is designed to address the problem of differential to common mode crosstalk in the IDCs of the connector.

SUMMARY OF THE INVENTION

The present invention can provide a communication connector that addresses the differential to common mode crosstalk issue described above, while also compensating for differential to differential crosstalk.

As a first aspect, embodiments of the present invention are directed to a communication connector comprising: a dielectric mounting substrate; and a plurality of pairs of conductive IDCs. Each of the IDCs has slots for receiving conductors at opposite upper and lower ends thereof. The IDCs are mounted in the mounting substrate in rows, with the upper ends of the IDCs facing upwardly, and the lower ends of the IDCs facing downwardly. The slots of each IDC are generally parallel and non-collinear. In this configuration, the IDCs can compensate for both differential to common mode crosstalk and differential to differential crosstalk between adjacent pairs of IDCs.

As a second aspect, embodiments of the present invention are directed to a communication connector comprising: a dielectric mounting substrate; and a plurality of pairs of conductive IDCs. Each of the IDCs has slots for receiving conductors at opposite upper and lower ends thereof. The IDCs are mounted in the mounting substrate in rows, with the upper ends of the IDCs facing upwardly, and the lower ends of the IDCs facing downwardly. Each pair of IDCs includes a crossover. This arrangement can enable the IDCs to compensate for both differential to common mode and differential to differential crosstalk between adjacent pairs of IDCs.

As a third aspect, embodiments of the present invention are directed to a communication connector comprising: a dielectric mounting substrate; and a plurality of pairs of conductive IDCs. Each of the IDCs has slots for receiving conductors at opposite upper and lower ends thereof. The IDCs are mounted in the mounting substrate in rows, with the upper ends of the IDCs facing upwardly, and the lower ends of the IDCs facing downwardly. The IDCs are configured and arranged such that the upper end of a first IDC of a first pair is nearer to an adjacent second pair of IDCs than the lower end of the first IDC, and the upper end of the second IDC of the first pair is farther from the second pair of IDCs than the lower end of the second IDC of the first pair.

As a fourth aspect, embodiments of the present invention are directed to a communication connector comprising: a dielectric mounting substrate; and a plurality of pairs of conductive IDCs. Each of the IDCs has slots for receiving conductors at opposite upper and lower ends thereof. The IDCs are mounted in the mounting substrate in rows, with the upper ends of the IDCs facing upwardly, and the lower ends of the IDCs facing downwardly. The IDCs are configured and arranged such that the upper end of a first IDC of a first pair is nearer to an adjacent second pair of IDCs than the tipper end of a second IDC of the first pair, and the lower end of the first IDC of the first pair is farther from the second pair of IDCs than the lower end of the second IDC of the first pair.

As a fifth aspect, embodiments of the present invention are directed to an IDC comprising: upper and lower ends, each of the upper and lower ends including a slot configured to receive a conductor therein, the slots being generally parallel and non-collinear; and a transitional area merging with the upper and lower ends. An IDC of this configuration can be employed, for example, in the connectors discussed above.

DETAILED DESCRIPTION OF EMBODIMENTS OF THE INVENTION

Figure 1:
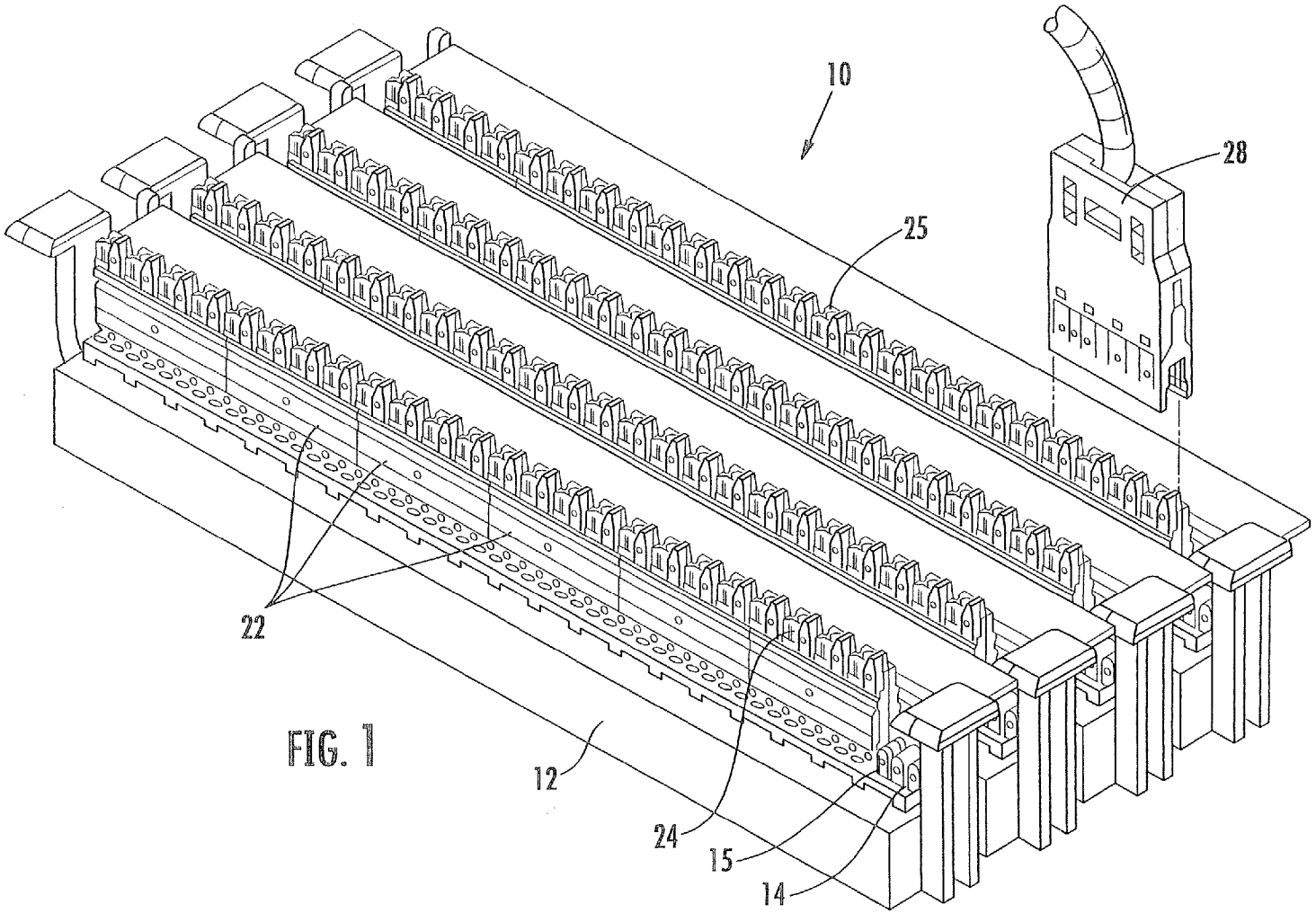
FIG. 1 is a perspective view of a data communications system employing a connector according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constrictions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Where used, the terms "attached", "connected", "interconnected", "contacting", "mounted" and the like can mean either direct or indirect attachment or contact between elements, unless stated otherwise. Where used, the terms "coupled," "induced" and the like can mean non-conductive interaction, either direct or indirect, between elements or between different sections of the same element, unless stated otherwise.

Referring now to the figures, a 110-style communication system, designated broadly at 10, is illustrated in FIG. 1. The communication system 10 comprises field-wired cable termination apparatus that is used to organize and administer cable and wiring installations. The main cross-connect is typically located in the equipment room and provides termination and cross-connection of network interface equipment, switching equipment, processor equipment, and backbone (riser or campus) wiring. The horizontal cross-connect is typically located in a telecommunications closet and provides termination and cross-connection of horizontal (to the work area) and backbone wiring. Cross-connects can provide efficient and convenient routing and rerouting of common equipment circuits to various parts of a building or campus.

The communication system 10 enables cable and wiring installations to be handled by technical or non-technical end user personnel. Line moves and rearrangement for the cabling termined at a cross-connect can be performed with patchcords (plug-ended jumpers) or cross-connect wire.

The communication system 10 has connector ports 15 arranged in staggered horizontal rows in uniformly spaced conductor seating arrays 14 (also known as index strips). FIG. 1 shows four rows of index strips 14 mounted in a typical terminal block 12. The spaces between these index strips 14 become troughs, typically for cable or cross-connect wire routing. Unsheathed cable conductors (not shown) are routed through the cable troughs and other cabling organizing structure to their appropriate termination ports in the index strips 14.

Connecting blocks 22, each containing multiple IDCs 24 in pairs, are placed over the index strips 14 and make electrical connections to the cable conductors. Cross-connect wire (not shown) or patch cords 28 are terminated in ports 25 defined by the IDCs 24 on the top of the connecting blocks 22.

Figure 2:
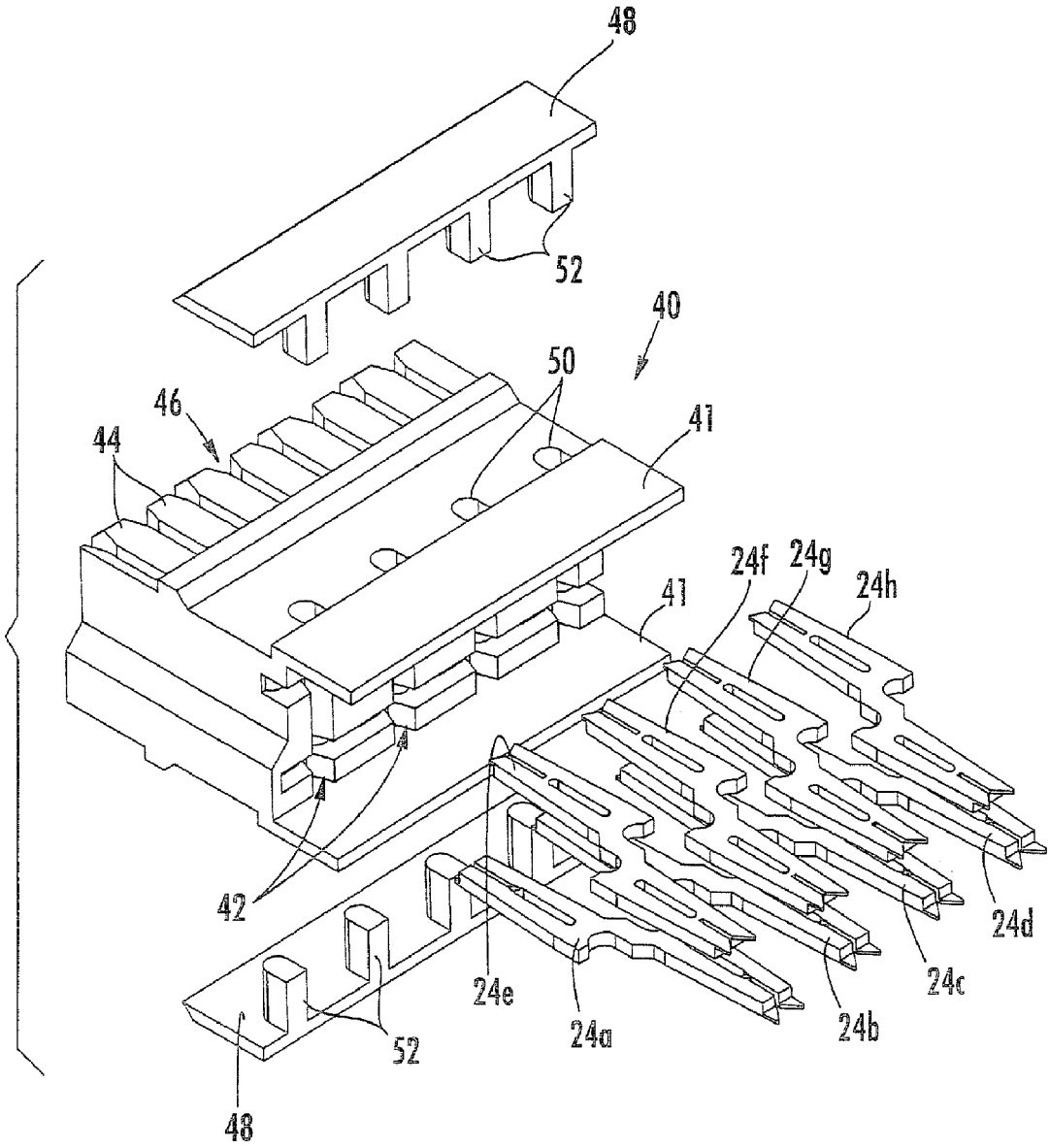
FIG. 2 is an exploded perspective view of a connector employed in the data communication system illustrated in FIG. 1.
Figure 3:
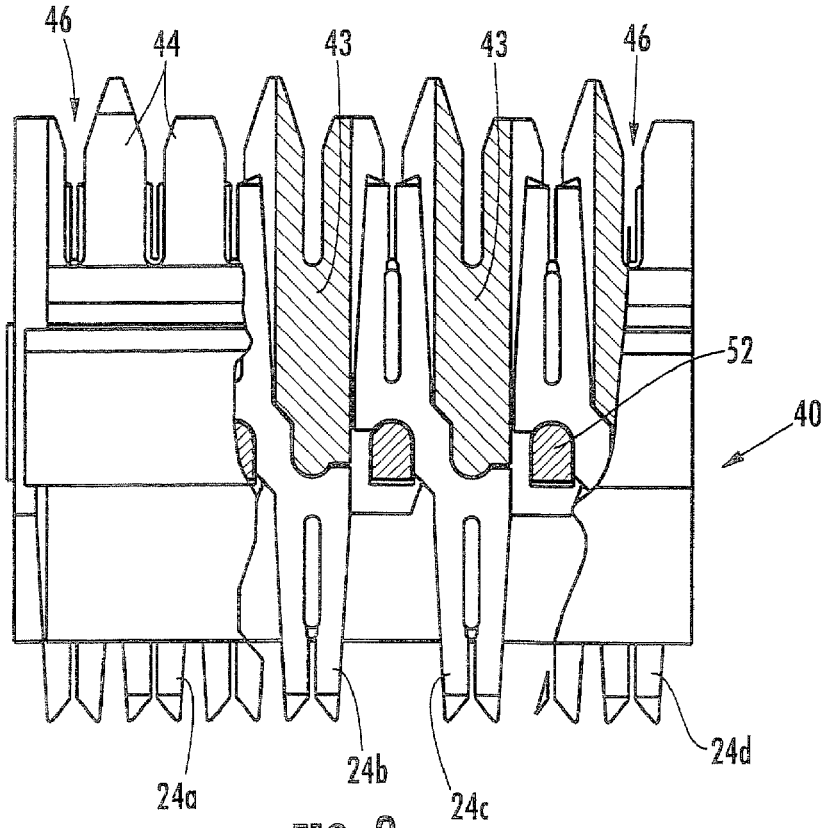
FIG. 3 is a front partial section view of the connector of FIG. 2.
Figure 4:
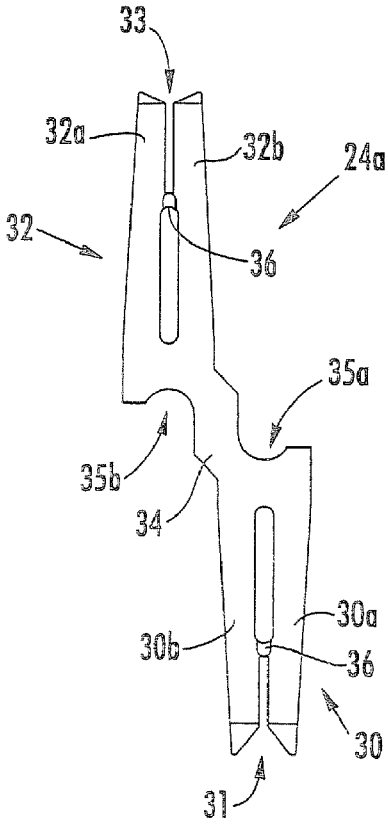
FIG. 4 is an enlarged front view of an exemplary IDC of the connector of FIG. 2.

Referring now to FIGS. 2-4, the connecting block 22 includes a main housing 40, two locking members 48, and eight IDCs 24*a*-24*h*. These components are described below.

FIG. 4 illustrates an exemplary IDC 24*a* of the connecting block 22 according to embodiments of the present invention (those skilled in this art will appreciate that the discussion of the IDC 24*a* is equally applicable to the other IDCs 24*b*-24*h*). The IDC 24*a* is generally planar and formed of a conductive material, such as phosphor bronze alloy. The IDC 24*a* includes a lower end 30 with prongs 30*a*, 30*b* that define an open-ended slot 31 for receiving a mating conductor, an tipper end 32 with prongs 32*a*, 32*b* that define an open-ended slot 33 for receiving another mating conductor, and a transitional area 34 that merges with the lower end 30 and the upper end 32. The transitional area 34 includes two arcuate engagement recesses 35*a*, 35*b*, each of which is positioned generally in line with and faces away from a respective slot 31, 33. Each of the slots 31, 33 is interrupted by a small brace 36 that provides rigidity to the prongs of the IDC 24*a* during manufacturing, but which splits during "punch-down" of conductors into the slots 31, 33. Notably, the lower and upper ends 30, 32 are offset from each other such that the slots 31, 33 are generally parallel and non-collinear; the offset distance between the slots 31, 33 in the lower and upper ends 30, 32 is typically between about 1.100 and 1.150 inches.

Referring now to FIGS. 2 and 3, the main housing 40, which is typically formed of a dielectric material such as polycarbonate, has alignment flanges 41 extending from the lower end thereof. The main housing 40 includes through slots 42 separated by dividers 43, each of the slots 42 being sized to receive the upper end 32 of an IDC 24*a*-24*h*. At their lower ends, the dividers 43 are arcuate and are configured to nest with the engagement recesses 35*a* of the IDCs 24*a*-24*h*. The upper end of the main housing 40 has multiple pillars 44 that are split by slits 46, wherein the slits 46 expose the inner edges of the open-ended slots 33 of the IDC upper ends 32. The main housing 40 also includes apertures 50 on each side.

Turning now to FIG. 2, the locking members 48, which are typically formed of a dielectric material such as polycarbonate, are mounted to the sides of the main housing 40. The locking members 48 include locking projections 52 that are received in the apertures 50 in the main housing 40. As can be seen in FIG. 3, the locking projections 52 have upwardly-facing arcuate surfaces that nest with the engagement recesses 35*b* of the IDCs 24*a*-24*h*.

As is illustrated in FIG. 2, the connecting block 22 can be assembled by inserting the IDCs 24*a*-24*h* into the slots 42 in the main housing 40 from the lower end thereof. The upper ends 32 of the IDCs 24*a*-24*h* fit within the slots 42, with the slots 33 of the tipper ends 32 of the IDCs 24*a*-24*h* being exposed by the slits 46 in the main housing 40. The recesses 35*a* of the IDCs 24*a*-24*h* engage the lower ends of respective dividers 43 of the main housing 40. Once the IDCs 24*a*-24*h* are in place, the locking members 48 are inserted into the apertures 50 such that the arcuate surfaces of the locking projections 52 engage the recesses 35*b* of the IDCs 24*a*-24*h*. The locking members 48 are then secured to the main housing 40 via ultrasonic welding, adhesive bonding, snap-fit latching, or some other suitable attachment technique. The interaction between the recesses 35*a*, 35*b*, the lower ends of the dividers 43, and the locking projections can anchor the IDCs 24*a*-24*h* in place and prevent twisting or rocking of the IDCs 24*a*-24*h* relative to the main housing 40 during punch-down.

Figure 5:
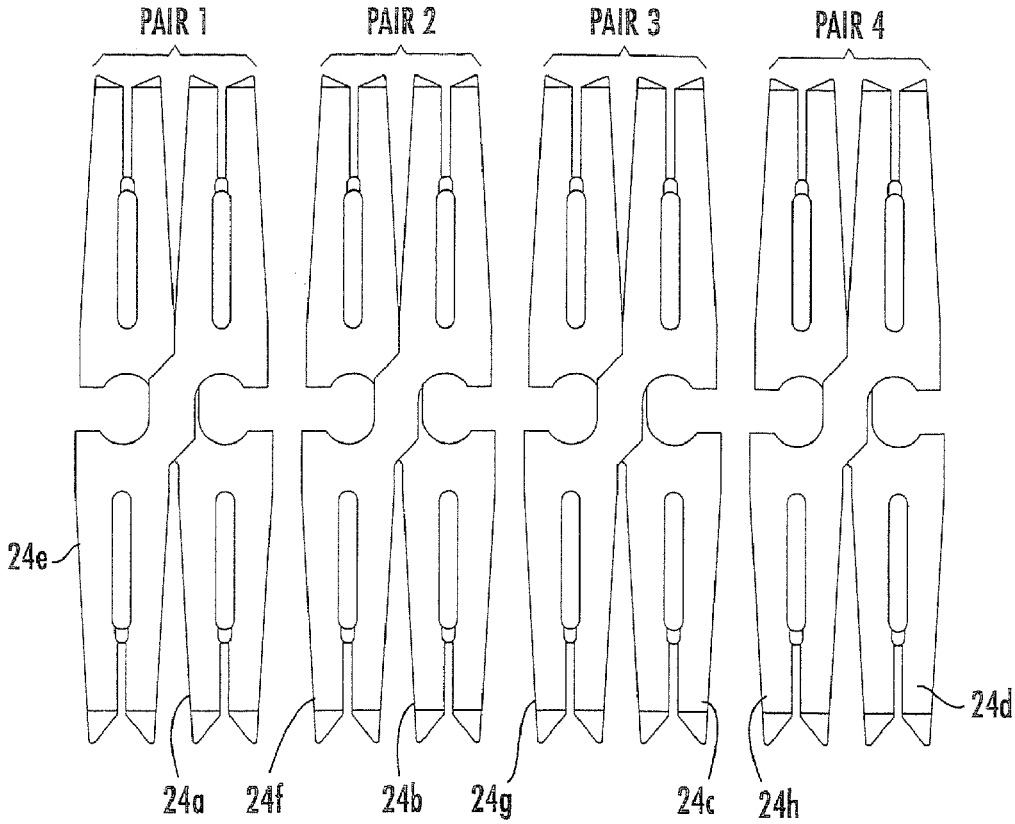
FIG. 5 is a side view of the arrangement of IDCs in the connector of FIG. 2.
Figure 6:
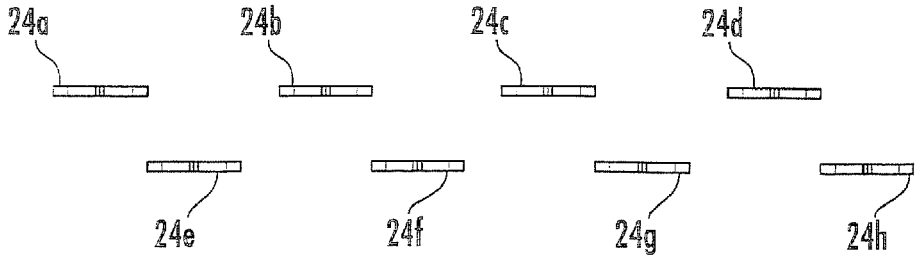
FIG. 6 is a top view of the IDCs of FIG. 5.
Figure 7:
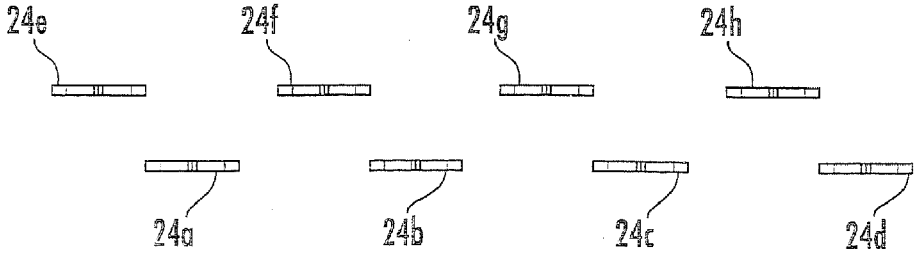
FIG. 7 is a bottom view of the IDCs of FIG. 5.

As can be seen in FIGS. 5-7, once in the main housing 40 the IDCs 24*a*-24*h* are arranged in two substantially planar rows, with IDCs 24*a*-24*d* in one row and IDCs 24*e*-24*h* in a second row. As can be seen in FIG. 6, the upper ends 32 of the IDCs 24*a*-24*d* in one row are staggered from the upper ends 32 of the IDCs 24*e*-24*h* in the other row, and, as can be seen in FIG. 7, the lower ends 30 of the IDCs 24*a*-24*d* are staggered from the lower ends 30 of the IDCs 24*e*-24*h*.

The IDCs 24*a*-24*h* can be divided into TIP-RING IDC pairs as set forth in Table 1 below.

TABLE 1

| IDC | Pair # | Type |
|---|---|---|
| 24a | 1 | TIP |
| 24b | 2 | TIP |
| 24c | 3 | TIP |
| 24d | 4 | TIP |
| 24e | 1 | RING |
| 24f | 2 | RING |
| 24g | 3 | RING |
| 24h | 4 | RING |

Thus, each of the RINGS of the IDC pairs are in one row, and each of the TIPS of the IDC pairs are in the other row.

As is best seen in FIG. 5, the resulting arrangement of the IDCs 24*a*-24*h* is one in which the IDCs of each pair "cross-over" each other. Also, in this embodiment the distance between (a) the upper end of the IDC of one pair and the IDCs of an adjacent pair and (b) the lower end of the other IDC of the pair and the lower ends of the IDCs of the adjacent pair are generally the same. As a result, the TIP of each pair and the RING of each pair are in close proximity to the IDCs of adjacent pairs for generally the same signal length and at generally the same distance. For example, as seen in FIG. 6, the upper end 32 of the RING of pair 1 (IDC 24*e*) is closer to the upper ends 32 of the TIP and RING of pair 2 (IDCs 24*b*, 24*f*) than is the upper end 32 of the TIP of pair 1 (IDC 24*a*). However, as can be seen in FIG. 7, the lower end 30 of the TIP of pair 1 (IDC 24*a*) is closer to the lower ends 30 of the TIP and RING of pair 2 (IDCs 24*b*, 24*f*) than is the lower end of the RING of pair 1 (IDC 24*e*). This pattern holds for all of the pairs of IDCs in the connecting block 22, and continues along the entire array of connecting blocks mounted on the index strip 14; in each instance, the exposure (based on signal length and proximity) of each IDC to the members of neighboring pairs of IDCs is generally the same.

As a consequence of this configuration, the IDCs can self-compensate for differential to common mode crosstalk. The opposite proximities on the upper and lower ends of the TIP and RING IDCs of one pair to the adjacent pair can compensate the capacitive crosstalk generated between the pairs. The presence of the crossover in the signal-carrying path defined by the IDCs can compensate for the inductive crosstalk generated between the pairs. At the same time the arrangement of the IDCs at the upper end 32 and the lower end 30 enables the IDCs to self-compensate for differential to differential crosstalk by locating each IDC in one pair approximately equidistant from the two IDCs in the adjacent pair nearest to it. Because both the differential to common mode crosstalk as well as the differential to differential crosstalk between pairs are compensated, the connecting block 22 can provide improved crosstalk performance, particularly at elevated frequency levels.

Those skilled in this art will appreciate that connecting blocks and IDCs according to embodiments of the present invention may take other forms. For example, the main housing and locking members may be replaced by a mounting substrate of a different configuration that holds the IDCs in place. The number of pairs of IDCs may differ from the four pairs illustrated herein or they may be unevenly spaced within or across connecting blocks. The IDCs may, for example, lack the brace 36 in the slots that receive conductors. Also, the IDCs may lack the engagement recesses or may include some other stricture (perhaps a tooth or nub) that engages a portion of the mounting substrate to anchor the IDCs. Also, IDCs as described above may be employed in connecting blocks of the "aligned" type discussed above or in another arrangement. Furthermore, the upper sections 32 and the lower sections 30 of the IDCs may be physically separated form each other and mounted to a printed wiring board in arrays similar to FIGS. 6 and 7, with plated through-holes and traces on the board completing the connections between them. Also, the principles of this invention can be applied to patch cord connectors designed to interconnect between IDC blocks, with equally beneficial results.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A connector block, comprising:

a housing having an upper end and a lower end;

a first pair of tip and ring conductive insulation displacement contacts (IDCs) mounted in the housing;

a second pair of tip and ring conductive IDCs mounted in the housing;

wherein each of the IDCs has an upper end that has a first slot and a lower end that has a second slot, the lower end being offset from the upper end;

wherein the tip IDCs are aligned in a first row within the housing and the ring IDCs are aligned in a second row within the housing;

wherein the upper end of the housing includes a plurality of slits that define a plurality of pillars, and wherein the first slot of each IDC is aligned with a respective one of the slits; and wherein at least portions of the lower end of each of the IDCs extend outside the housing through one or more openings in the lower end of the housing.

2. The connector block of claim 1, further comprising at least one alignment flange extending from the lower end of the housing.

3. The connector block of claim 1, further comprising a third pair of conductive tip and ring IDCs mounted in the housing and a fourth pair of conductive tip and ring IDCs mounted in the housing.

4. The connector block of claim 1, wherein each of the IDCs is substantially planar.

5. The connector block of claim 1, wherein the upper end of a first IDC of the first pair of IDCs is substantially equidistant from the upper ends of both IDCs of the second pair of IDCs.

6. The connector block of claim 1, wherein the IDCs of the first pair of IDCs cross over each other and wherein the IDCs of the second pair of IDCs cross over each other.

7. The connector block of claim 1, wherein the upper end and the lower end of each IDC of the first pair of IDCs merge at a transitional area that includes at least one arcuate engagement recess that engages a structure within the housing.

8. The connector block of claim 1, wherein the IDCs are arranged such that an upper end of a first IDC of the first pair of IDCs is nearer to the second pair of IDCs than is a lower end of the first IDC of the first pair of IDCs, and an upper end of the second IDC of the first pair of IDCs is farther from the second pair of IDCs than is a lower end of the second IDC of the first pair of IDCs.

9. The connector block of claim 1, wherein the first slot and the second slot of each IDC are generally parallel and non-collinear.

10. A connector block, comprising:

a housing having an upper end and a lower end;

at least one alignment flange extending from the lower end of the housing;

a first pair of tip and ring conductive insulation displacement contacts (IDCs) mounted in the housing;

a second pair of tip and ring conductive IDCs mounted in the housing;

wherein each of the IDCs has an upper end that has a first slot and a lower end that has a second slot, the first slot and the second slot of each IDC being generally parallel and non-collinear;

wherein the tip IDCs are aligned in a first row within the housing and the ring IDCs are aligned in a second row within the housing; and wherein at least portions of the lower end of each of the IDCs extend outside the housing through one or more openings in the lower end of the housing.

11. The connector block of claim 10, further comprising a third pair of conductive tip and ring IDCs mounted in the housing and a fourth pair of conductive tip and ring IDCs mounted in the housing.

12. The connector block of claim 10, wherein each of the IDCs is substantially planar.

13. The connector block of claim 10, wherein the upper end of a first IDC of the first pair of IDCs is substantially equidistant from the upper ends of both IDCs of the second pair of IDCs.

14. A connector block, comprising:

a housing having an upper end and a lower end;

at least one alignment flange extending from the lower end of the housing;

a first pair of tip and ring conductive insulation displacement contacts (IDCs) mounted in the housing;

a second pair of tip and ring conductive IDCs mounted in the housing;

wherein each of the IDCs has an upper end that has a first slot and a lower end that has a second slot, the lower end being offset from the upper end;

wherein the tip IDCs are aligned in a first row within the housing and the ring IDCs are aligned in a second row within the housing;

wherein at least portions of the lower end of each of the IDCs extend outside the housing through one or more openings in the lower end of the housing; and wherein the upper and lower ends of the IDCs of the first pair of IDCs and the upper and lower ends of the IDCs of the second pair of IDCs are located to self-compensate for crosstalk between the IDCs of the first and second pairs of IDCs.

15. The connector block of claim 14, wherein the upper end of a first IDC of the first pair of IDCs is substantially equidistant from the upper ends of both IDCs of the second pair of IDCs.

16. The connector block of claim 14, further comprising at least one alignment flange extending from the lower end of the housing.

17. The connector block of claim 14, further comprising a third pair of conductive tip and ring IDCs mounted in the housing and a fourth pair of conductive tip and ring IDCs mounted in the housing.

18. The connector block of claim 14, wherein the IDCs of the first pair of IDCs cross over each other and wherein the IDCs of the second pair of IDCs cross over each other.

19. The connector block of claim 14, wherein the IDCs are arranged such that an upper end of a first IDC of the first pair of IDCs is nearer to the second pair of IDCs than is a lower end of the first IDC of the first pair of IDCs, and an upper end of the second IDC of the first pair of IDCs is farther from the second pair of IDCs than is a lower end of the second IDC of the first pair of IDCs.

20. The connector block of claim 14, wherein the first slot and the second slot of each IDC are generally parallel and non-collinear.

* * * * *

UNITED STATES PATENT AND TRADEMARK OFFICE

CERTIFICATE OF CORRECTION

PATENT NO. : 7,322,847 B2
APPLICATION NO. : 11/689047
DATED : January 29, 2008
INVENTOR(S) : Hashim et al.

It is certified that error appears in the above-identified patent and that said Letters Patent is hereby corrected as shown below:

On Title Page:

Item 56, References Cited, U.S. Patent Documents:

Please delete "5,961,340 A * 10/1999 Littlejohn et al. .....439/403"
And add -- 5,961,341 A * 10/1999 Daoud, Bassel Hage...439/403 --

Signed and Sealed this

Third Day of June, 2008

JON W. DUDAS
*Director of the United States Patent and Trademark Office*